US005236336A

United States Patent [19]

Hitoshi

[11] Patent Number: 5,236,336

[45] Date of Patent: Aug. 17, 1993

[54] HEAT EXCHANGER

[75] Inventor: Chigira Hitoshi, Gunma, Japan

[73] Assignee: Sanden Corporation, Gunma, Japan

[21] Appl. No.: 802,568

[22] Filed: Dec. 5, 1991

[30] Foreign Application Priority Data

Dec. 5, 1990 [JP] Japan ..... 2-400112[U]

[51] Int. Cl.[5] ..... F28D 1/04; F28F 9/02

[52] U.S. Cl. ..... 165/153; 165/173; 165/176

[58] Field of Search ..... 165/152, 153, 173, 176

[56] References Cited

U.S. PATENT DOCUMENTS 2,063,757 12/1936 Saunders ..... 165/153
4,662,470 5/1987 Fujisawa et al. ..... 180/219

FOREIGN PATENT DOCUMENTS 484577 10/1929 Fed. Rep. of Germany ..... 165/176
58-49897 3/1983 Japan ..... 165/152
59-104096 6/1984 Japan ..... 165/176
61-76890 4/1986 Japan ..... 165/176

*Primary Examiner*—Allen J. Flanigan
*Attorney, Agent, or Firm*—Baker & Botts

[57] ABSTRACT

A heat exchanger for a refrigeration circuit includes a plurality of fluid tubes aligned in a parallel relationship with each other and corrugated fins disposed therebetween. A pair of header portions are connected with the ends of the fluid tubes. The header portions includes plate members which have a plurality of elongated holes for receiving the ends of the fluid tubes therein. Cup-shaped members are disposed in sealing contact with end surfaces of the plate members to cover the ends of the fluid tubes. With this construction, the refrigerant passageways can be securely maintained. Further, the core of a heat exchanger can be shaped to conform to the space available for mounting the heat exchanger, to thereby enhance the efficiency of the heat exchanger.

11 Claims, 4 Drawing Sheets

HEAT EXCHANGER

TECHNICAL FIELD

The present invention relates to a heat exchanger, and more particularly, to a heat exchanger for use in an engine compartment of an automobile; e.g., the heat exchanger can be formed as a condenser or an evaporator for an automotive air conditioning system or radiator.

BACKGROUND OF THE INVENTION

A conventional condenser for use in an automobile, as shown in U.S. Pat. No. 4,825,941, is well known. The condenser includes a pair of headers which are parallel to each other. A plurality of fluid tubes are connected to the headers at their ends. Corrugated fins are provided to extend across air paths defined between adjacent fluid tubes. Each header is made of an aluminum pipe which has a circular cross-section. The headers are internally divided by partitions to form at least two groups of coolant passageways. One group is located toward the inlet and the other group is located toward the outlet. As a result, the flow of the coolant makes at least one U-turn in the header.

The partition is inserted into the header through a slit. The outer peripheral surface of the partition, which is inserted into the interior of the header, is formed to matingly contact the inside wall surface of the header. However, it is difficult to maintain a secure contact between the outer peripheral surface of the partition and the inside wall surface of the header. In addition, the partition and the header are soldered together inside of the header. Hence, the condition of the soldering can not be seen from the outside. Accordingly, uncertainty exists as to whether the soldering has formed a complete seal.

Furthermore, the condenser is mounted with much other equipment in the limited space of an engine compartment of an automobile. The available space to mount the condenser is therefore not always sufficient. Accordingly, it would be preferable for the condenser to be formed in a shape adapted to the shape of the available space in which the condenser is mounted, so that the largest core possible for the condenser could be used in the limited space. However, since the headers of the condensers are made of pipes, great difficulty has existed in adapting the condenser to the available shape in the engine compartment. The cores of the condensers have necessarily been formed with a planar shape.

SUMMARY OF THE INVENTION

It is a primary object of this invention to provide a heat exchanger in which the refrigerant passageways can be securely maintained.

It is another object of this invention to provide a heat exchanger in which the core can be adapted to the shape of the space available for mounting the heat exchanger. This is accomplished by providing a nonplanar core which appears step-like in profile.

A heat exchanger for a refrigeration circuit according to the present invention includes a plurality of fluid tubes which are arranged in a parallel relationship with each other and corrugated fins which are disposed between the fluid tubes. A pair of header portions are connected to the ends of the fluid tubes. The header portions include plate members which have a plurality of elongated holes for receiving the ends of the fluid tubes therein and cup-shaped members disposed in sealing contact with the plate members to cover the ends of the fluid tubes.

Further objects, features and other aspects of the invention will be understood from the detailed description of the preferred embodiments of this invention with reference to the drawings.

DETAILED DESCRIPTION OF THE PREFERRED EMBODIMENTS

Figure 1:
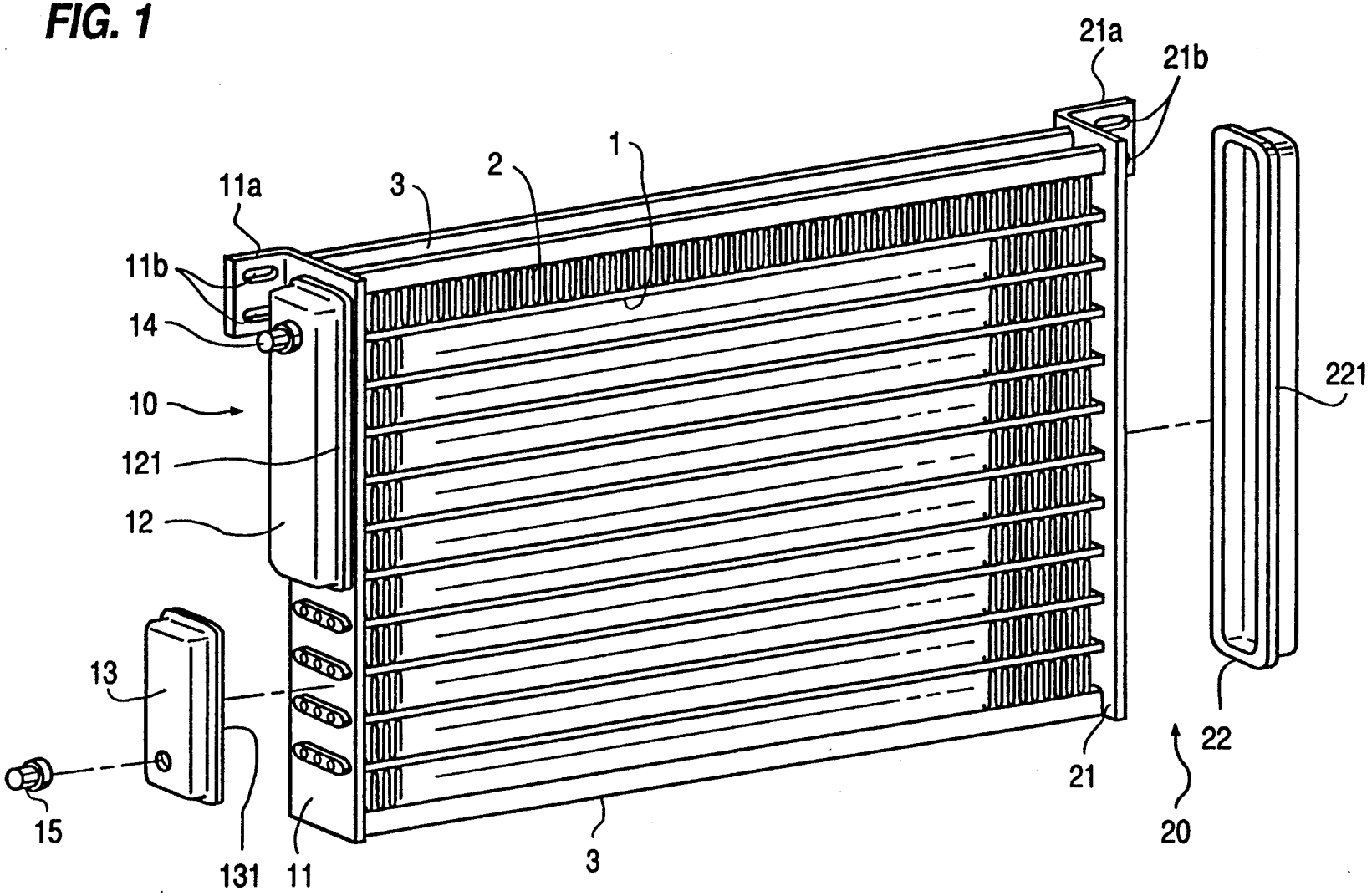
FIG. 1 is a partly exploded perspective view of a heat exchanger in accordance with one embodiment of this invention.

FIG. 1 illustrates a construction of a condenser in accordance with one embodiment of this invention.

A plurality of fluid tubes 1 are aligned in a parallel relationship with each other. Fluid tubes 1 are spaced apart from each other to define a certain gap between adjacent tubes. Each fluid tube 1 is formed as a flat tube which includes a plurality of refrigerant flow passages defined by longitudinal dividing walls. Corrugated fins 2 are disposed in each of the gaps defined between adjacent fluid tubes 1. Reinforcement members 3 are fixedly disposed on the corrugated fins 2 positioned at the upper and lower ends of the core to prevent its deformation.

Header 10 includes plate portion 11 and cup-shaped portions 12 and 13. Similarly, header 20 also includes plate portion 21 and cup-shaped portion 22. Plate portions 11 and 21 have a plurality of vertically aligned slits and attachment portions 11*a* and 21, respectively. The ends of fluid tubes 1 are fixedly fitted into the slits. Cup-shaped portions 12, 13 and 22 are formed with a pressing or drawing process and are shaped to have flanges 121, 131 and 221 on the peripheral surfaces thereof. Cup-shaped portion 12 is disposed on plate portion 11 such that the peripheral surface of flange 121 sealingly contacts the outer surface of plate portion 11 and covers the ends of fluid tubes 1 along the upper end of the condenser. Cup-shaped portion 13 is also disposed on plate portion 11 such that the peripheral surface of flange 131 sealingly contacts the outer surface of plate portion 11 and covers the remaining ends of fluid tubes on the lower end of the condenser. Inlet union 14 or other fitting, for introducing refrigerant into the heat exchanger from a refrigerant circuit, is provided on cup-shaped portion 12. An outlet union 15 or other fitting, for discharging the refrigerant to the refrigerant circuit, is provided on cup-shaped portion 13. Cup-shaped portion 22 is disposed on plate portion 21 such that the peripheral surface of flange 221 sealingly contacts the outer surface of plate portion 21 and covers all of the ends of fluid tubes 1 connected to plate 21.

Attachment portion 11*a* and 21*a* have elongated holes 11*b* and 21*b* for receiving screws therethrough to facilitate mounting of the condenser.

In the above construction of a condenser, the refrigerant is introduced into the interior of cup-shaped portion 12 of header 10 from a refrigeration circuit through inlet union 14. The refrigerant in cup-shaped portion 12 flows into fluid tubes 1 on the upper end of the condenser and exchanges heat with the air passing through corrugated fins 2 engaged with the noted fluid tubes 1. The refrigerant then flows into the interior of cup-shaped portion 22 of header 20 and goes downwardly along the inner surface of cup-shaped portion 22. The refrigerant thereafter flows into fluid tubes 1 on the lower end of plate 21 and further exchanges heat with the air passing through corrugated fins 2 in contact with the lower fluid tubes 1. The refrigerant then flows into the interior of cup-shaped portion 13 and out to the refrigeration circuit through outlet union 15. Accordingly, a plurality of serpentine fluid passages are formed within the core.

As mentioned above, headers 10 and 20 are easily formed by soldering flanges 121, 131 and 221 of cup-shaped portions 12, 13 and 22 onto the outer surfaces of plate portions 11 and 21. This construction permits the soldering to be easily seen from the outside, and thus enables manufacturing of a heat exchanger with high reliability.

Figure 2:
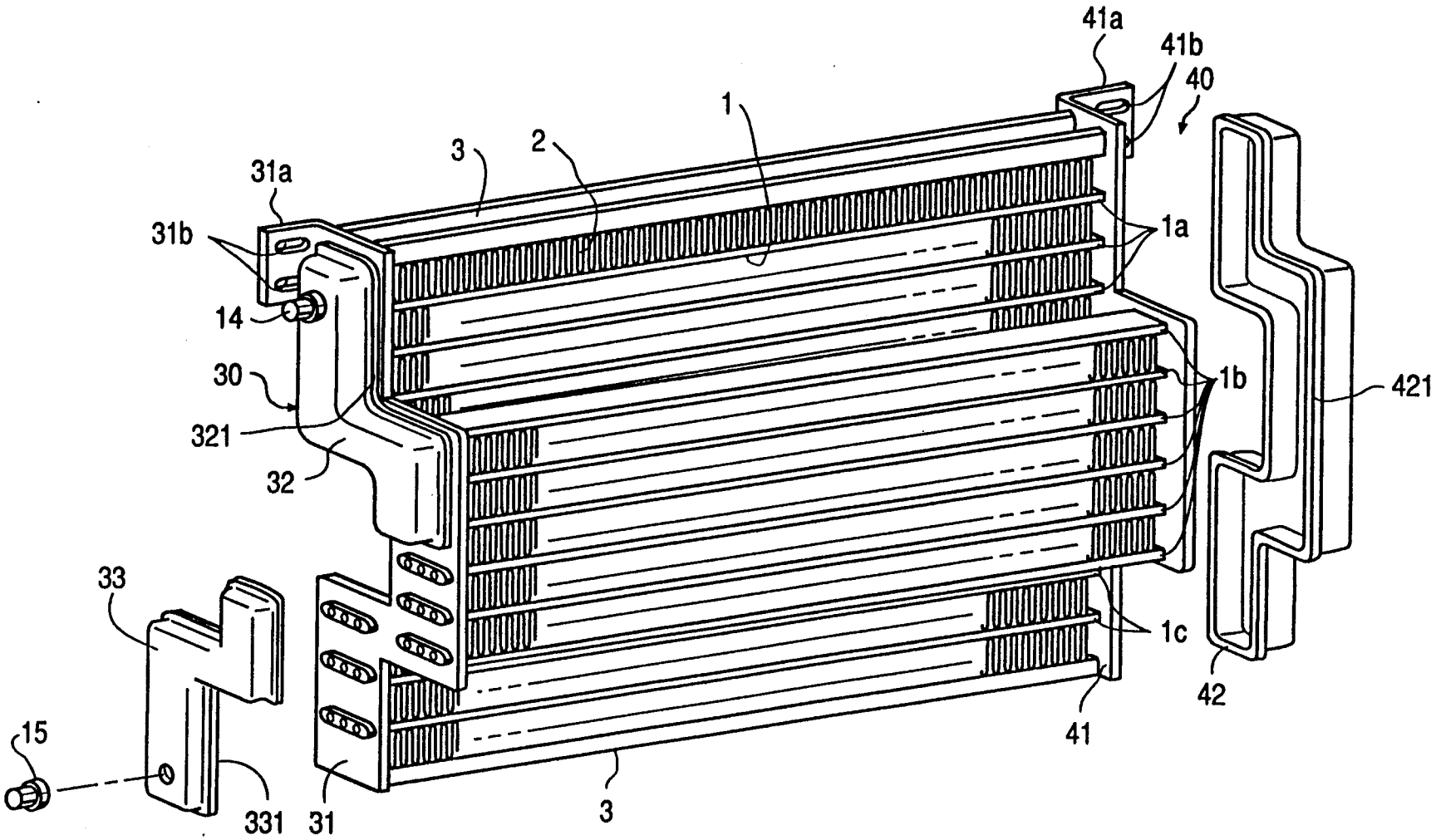
FIG. 2 is a partly exploded perspective view of a heat exchanger in accordance with another embodiment of this invention.

FIG. 2 illustrates a construction of a condenser in a accordance with another embodiment of this invention. The same reference numerals are accorded on the same construction as shown in FIG. 1. The same description of the construction as the above embodiment is omitted to simplify the specification.

Figure 3:
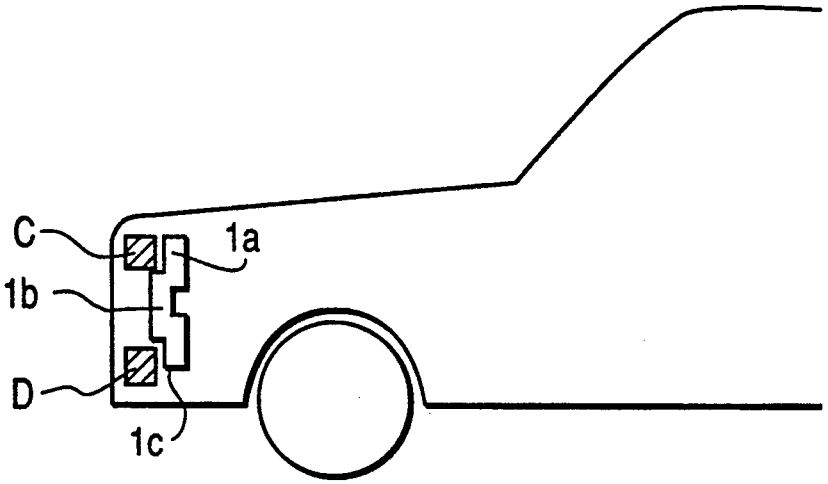
FIG. 3 is a schematic view of the embodiment of FIG. 2 showing an example of mounting the heat exchanger in an engine compartment.

Fluid tubes 1 are aligned in a parallel relationship with each other and are divided into three parts, i.e., upper, middle and lower tubes 1*a*, 1*b* and 1*c*. Middle tubes 1*b* are disposed to extend between the other equipment C and D when installed in an engine compartment and toward the front of an automobile relative to upper and lower tubes 1*a* and 1*c*, as shown in FIG. 3.

Header 30 includes plate portion 31 and cup-shaped portions 32 and 33. Header 40 likewise includes plate portion 41 and cup-shaped portion 42. Plate portions 31 and 41 are formed to conform to the offset arrangement of tubes 1 as mentioned above. Further, each plate portion 31, 41 has a plurality of vertically aligned slits to receive the tubes 1 of each group and attachment portions 31*a* and 41*a*, respectively. The ends of fluid tubes 1 are fixedly fitted in the slits. Cup-shaped portions 32, 33 and 42 are formed with a pressing or drawing process and shaped to define flanges 321, 331 and 421 on the peripheral surfaces thereof, respectively. Cup-shaped portion 32 is disposed on plate portion 31 such that the peripheral surface of flange 321 sealingly contacts the outer surface of plate portion 31 and covers the ends of upper tubes 1*a* and the upper half of middle tubes 1*b*. Cup-shaped portion 33 is similarly disposed on plate portion 31 such that the peripheral surface of flange 331 sealingly contacts the outer surface of plate portion 31 and covers the remaining ends of middle and lower tubes 1*b* and 1*c*. Inlet union 14 for introducing refrigerant from a refrigerant circuit is provided on cup-shaped portion 32. Outlet union 15 for discharging the refrigerant to the refrigerant circuit is provided on cup-shaped portion 33. Cup-shaped portion 42 is disposed on plate portion 41 such that the peripheral surface of flange 421 sealingly contacts the outer surface of plate portion 41 and covers all of the ends of upper, middle and lower tubes 1*a*, 1*b* and 1*c* on plate portion 41. Attachment portions 31*a* and 41*a* have elongated holes 31*b* and 41*b* for receiving screws therethrough to facilitate mounting of the condenser.

In the above construction of a condenser, the refrigerant is introduced into the interior of cup-shaped portion 32 of header 30 from a refrigeration circuit through inlet union 14. The refrigerant in cup-shaped portion 32 flows into upper tubes 1*a* and the upper half of middle tubes 1*b* and exchanges heat with the air passing through corrugated fins 2 engaged therewith. The refrigerant then flows into the interior of cup-shaped portion 42 of header 40 and goes downwardly along the inner surface of cup-shaped portion 42. The refrigerant thereafter flows into the remaining half of middle tubes 1*b* and lower tubes 1*c* and further exchanges heat with the air passing through the engaged corrugated fins 2. Thereafter, the refrigerant flows into the interior of cup-shaped portion 33 out to the refrigerantion circuit through outlet union 15. Accordingly, a plurality of serpentine fluid passages are formed within the core.

Figure 4:
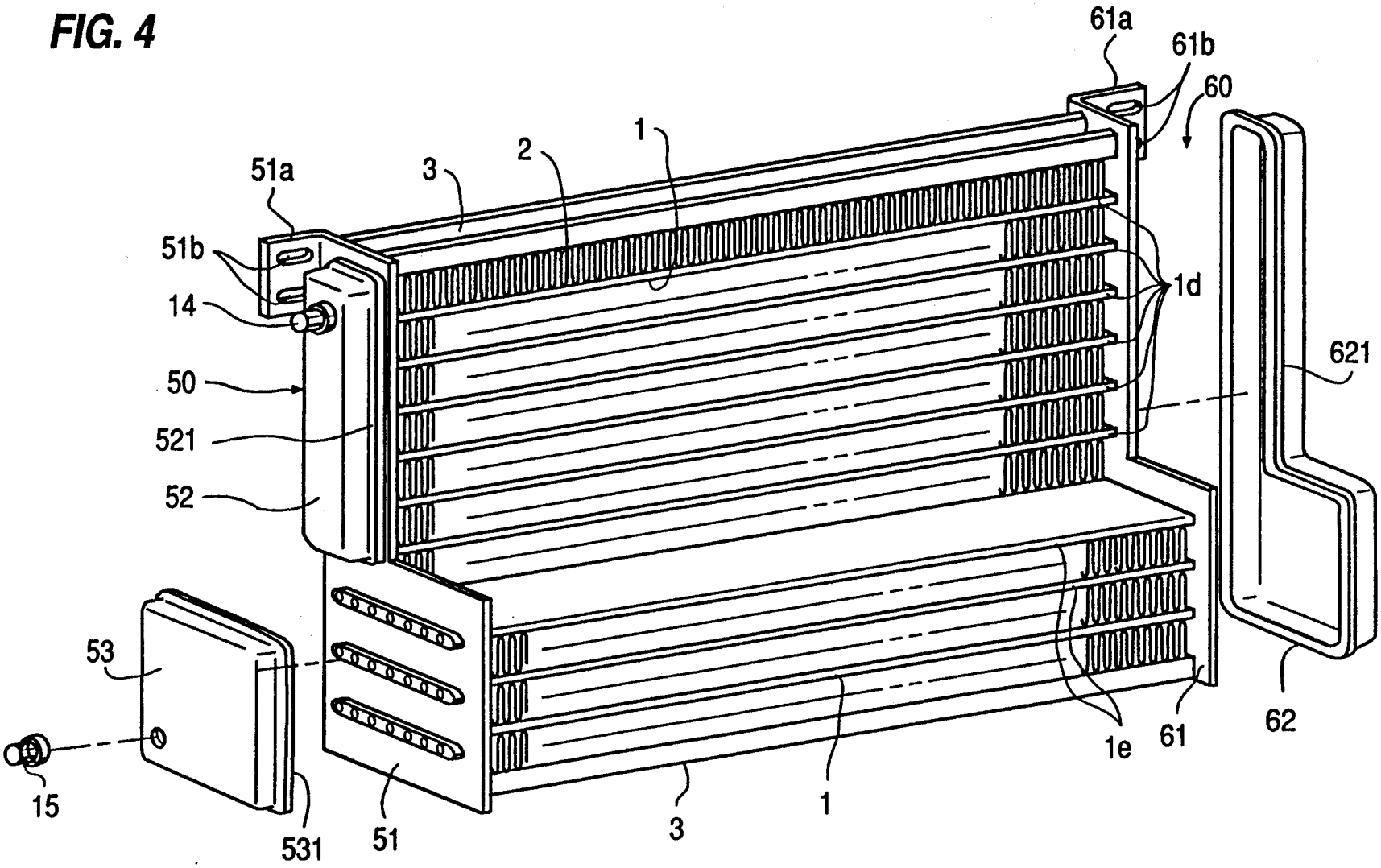
FIG. 4 is a partly exploded perspective view of a heat exchanger in accordance with still another embodiment of this invention.

FIG. 4 illustrates a construction of a condenser in accordance with still another embodiment of this invention. The same reference numerals are accorded on the same construction as shown in FIG. 1. The same description of the construction as the above embodiment is omitted to simplify the specification.

Figure 5:
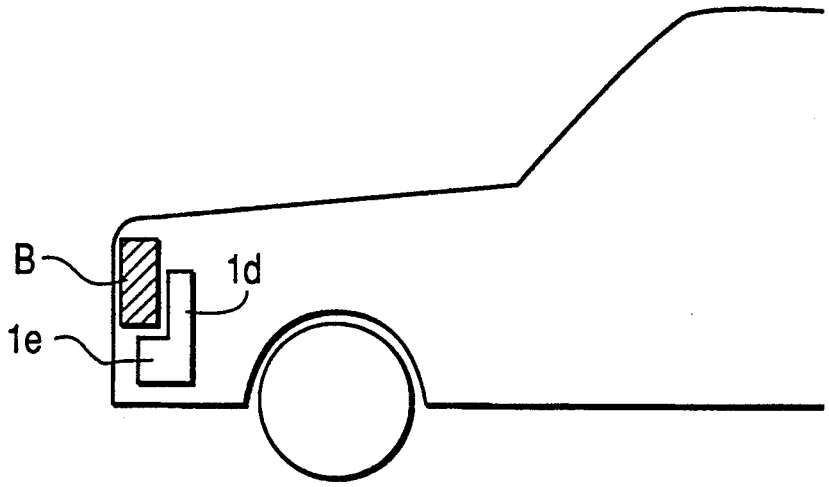
FIG. 5 is a schematic view of the embodiment of FIG. 4 showing an example of mounting the heat exchanger in an engine compartment.

Fluid tubes 1 are aligned in parallel with each other and divided into two parts, i.e., upper and lower tubes 1*d* and 1*e*. Lower tubes 1*e* are disposed to extend under other equipment A installed in a engine compartment and toward front of an automobile relative to upper tubes 1*d*, as shown in FIG. 5. The width of lower tubes 1*e* is broader than that of upper tubes 1*d*. Accordingly, the cross-section of tubes 1 is L-shaped.

Header 50 includes plate portion 51 and cup-shaped portions 52 and 53. Header 60 includes plate portion 61 and cup-shaped portion 62. Plate portions 51 and 61 are formed to conform to the arrangement of tubes 1 as mentioned above. Each plate portion 51, 61 defines a plurality of vertically aligned slits to receive the tubes 1 of each group, and attachment portions 51*a* and 61*a*, respectively. The ends of fluid tubes 1 are fixedly fitted in the slits. Cup-shaped portions 52, 53 and 62 are formed with a pressing or drawing process and shaped to have flanges 521, 531 and 621 on the peripheral surfaces thereof, respectively. Cup-shaped portion 52 is disposed on plate portion 51 such that the peripheral surface of flange 521 sealingly contacts the outer surface of plate portion 51 and covers the ends of upper tubes 1*d*. Cup-shaped portion 53 is also disposed on plate portion 51 such that the peripheral surface of flange 531 sealingly contacts the outer surface of plate portion 51 and covers the ends of lower tubes 1*e*. Inlet union 14 for introducing refrigerant from a refrigerant circuit is provided on cup-shaped portion 52. Outlet union 15 for discharging the refrigerant to the refrigerant circuit is provided on cup-shaped portion 53. Attachment portions 31*a* and 41*a* have elongated holes 31*b* and 41*b* for receiving screws therethrough for mounting the heat exchanger.

In the above construction of a condenser, the refrigerant is introduced into the interior of cup-shaped portion 52 of header 50 from a refrigeration circuit through inlet union 14. The refrigerant in cup-shaped portion 52 flows into upper tubes 1*d* and exchanges heat with the air passing through the corresponding corrugated fins 2.

The refrigerant then flows into the interior of cup-shaped portion 62 of header 60 and goes downwardly along the inner surface of cup-shaped portion 62. The refrigerant thereafter flows into lower tubes 1*e* and further exchanges heat with the air passing through corrugated fins 2. Thereafter, the refrigerant flows into the interior of cup-shaped portion 53 out to the refrigeration circuit through outlet union 15. Accordingly, a plurality of serpentine fluid passages are formed within the core.

In any of the embodiments, a plurality of cup-shaped members may be used on each header portion to increase the number of turns in the refrigerant flow path. Moreover, the positions of the inlet and outlet unions 14, 15 or other fittings could be rearranged to fit the particular operation.

This invention has been described in detail in connection with the preferred embodiments. These embodiments, however, are merely for example only and the invention is not restricted thereto. It will be understood by those skilled in the art that the other variations and modifications can easily be made within the scope of this invention as defined by the claims.

I claim:

1. A heat exchanger for a refrigeration circuit including a plurality of fluid tubes aligned in a parallel relationship with each other, corrugated fins disposed between said fluid tubes, and a header portion connected with each end of said fluid tubes, said header portions including plate members having a plurality of holes for inserting said ends of said fluid tubes therein and cup-shaped members disposed in sealing contact on end surfaces of said plate members to cover the ends of said fluid tubes wherein the fluid tubes are grouped into a plurality of sections, each section containing a plurality of the fluid tubes, and wherein at least one of said sections protrudes transversely outward with respect to the at least one other section of fluid tubes such that said heat exchanger has a step-like profile as seen in end view from at least one of said header portions.

2. A heat exchanger comprising:

a plurality of heat exchange tubes each defining a longitudinal axis, a flow path extending generally along said longitudinal axis for the passage of a heat medium therethrough, and a pair of open ends, said heat exchange tubes being arranged in a parallel relationship in a direction along said longitudinal axes, wherein the tubes are grouped into a plurality of sections, each section containing a plurality of the tubes, at least one of the sections being positioned such that the longitudinal axes of its tubes are substantially equally laterally offset from the longitudinal axes of other of said heat exchange tubes; and a pair of header portions, each said header portion being attached to one of said open ends of each of said heat exchange tubes, each said header portion including a plate member defining a plurality of openings for receiving said ends of said heat exchange tubes and at least one cover sealingly engaged with said plate member to define a cavity therebetween in communication with said open ends of said tubes;

wherein said heat exchanger has a step-like profile as seen in end view from at least one of said header portions.

3. The heat exchanger of claim 2 wherein one of said header portions includes a plurality of covers which are attached to said plate to thereby form separate cavities in communication with the open ends of said heat exchange tubes.

4. The heat exchanger of claim 3 wherein the other of said header portions includes a number of covers which is one less than the number of covers in said one header portion.

5. A heat exchanger having a pair of sides and comprising:

a plurality of heat exchange tubes each defining a flow path for receiving a heat medium therethrough, each tube having a pair of side edges which collectively define the sides of said heat exchanger, and a pair of open ends, said heat exchange tubes being arranged in a parallel relationship, wherein the tubes are grouped into a plurality of sections, each section containing a plurality of the tubes, and wherein in at least one of the sections all of the tubes of the at least one section have the same corresponding side edges substantially equally offset from the corresponding side edges of other of said sections; and a pair of header portions, each said header portion being attached to one of said open ends of each of said heat exchange tubes, each said header portion including a plate member defining a plurality of openings for receiving said ends of said heat exchange tubes and at least one cover sealingly engaged with said plate member to define a cavity therebetween in communication with said open ends of said tubes;

wherein said heat exchanger has a step-like profile as seen in end view from at least one of said header portions.

6. The heat exchanger of claim 5 wherein said at least one section is positioned relative to said other of the sections so that both of the side edges of each tube of the at least one section are offset from the corresponding side edges of said other of said sections.

7. The heat exchanger of claim 5 wherein said at least one section has at least one tube with a wider construction relative to said other of said sections so that only one of said side edges of the at least one tube is offset from the corresponding side edges of said other of said sections.

8. The heat exchanger of claim 5 wherein one of said header portions includes a plurality of covers which are attached to said plate to thereby form separate cavities in communication with the open ends of said heat exchange tubes.

9. The heat exchanger of claim 5 wherein the other of said header portions includes at least one cover which is one less than the number of covers in said one header portion.

10. A heat exchanger having a pair of sides and comprising:

a plurality of heat exchange tubes each defining a flow path for receiving a heat medium therethrough, a pair of side edges which collectively define the sides of said heat exchanger, and a pair of open ends, said heat exchange tubes being arranged in a parallel relationship, and at least one of said tubes having at least one of its side edges offset from the corresponding side edges of other of said heat exchange tubes; and a pair of header portions, each said header portion being attached to one of said open ends of each of said heat exchange tubes, each said header portion including a plate member defining a plurality of openings for receiving said ends of said heat exchange tubes and at least one cover sealingly engaged with said plate member to define a cavity therebetween in communication with said open ends of said tubes, wherein said at least one tube has a wider construction relative to said other of said heat exchange tubes so that only one of said edges of said at least one tube is offset from the corresponding side edges of said other of said heat exchange tubes.

11. A heat exchanger for a refrigeration circuit including a plurality of fluid tubes aligned in a parallel relationship with each other, corrugated fins disposed between said fluid tubes, and a header portion connected with each end of said fluid tubes, said header portions including plate members having a plurality of holes for inserting said ends of said fluid tubes therein and cup-shaped members disposed in sealing contact on end surfaces of said plate members to cover the ends of said fluid tubes wherein the fluid tubes are grouped into a plurality of sections, each section containing a plurality of the fluid tubes, and wherein at least one of said sections protrudes transversely outward with respect to the at least one other section of fluid tubes wherein one of said header portions has at least two cup-shaped members and the other one of said header portions has one less cup-shaped member than the first mentioned header portion, so that the flow of the fluid makes at least one U-turn in at least one of said header portions.

* * * * *

UNITED STATES PATENT AND TRADEMARK OFFICE

CERTIFICATE OF CORRECTION

PATENT NO. : 5,236,336

DATED : August 17, 1993

INVENTOR(S) : Hitoshi CHIGIRA

It is certified that error appears in the above-identified patent and that said Letters Patent is hereby corrected as shown below:

Title page, item [19], delete "Hitoshi" and insert --Chigira--;

Title page, item [75], Inventor: delete "Chigira Hitoshi" and insert --Hitoshi Chigira--;

Column 1, line 66, delete "to" and insert --with--;

Column 4, line 20, delete "refrigerantion" and insert --refrigeration--; and

Column 7, line 9, before "edges" insert --side--

Signed and Sealed this

Twelfth Day of April, 1994

*Attest:*

*Attesting Officer*

BRUCE LEHMAN

*Commissioner of Patents and Trademarks*